US005252890A

United States Patent [19]

Yasuda

[11] Patent Number: 5,252,890

[45] Date of Patent: Oct. 12, 1993

[54] COMPACT TYPE FLUORESCENT LAMP DEVICE HAVING CROOKED ARC PATH

[75] Inventor: Takeo Yasuda, Yokohama, Japan

[73] Assignee: Toshiba Lighting and Technology Corporation, Tokyo, Japan

[21] Appl. No.: 925,429

[22] Filed: Aug. 10, 1992

Related U.S. Application Data

[63] Continuation of Ser. No. 581,216, Sep. 11, 1990, abandoned.

[30] Foreign Application Priority Data

Sep. 12, 1989 [JP] Japan ..... 1-234656

[51] Int. Cl.[5] ..... H01J 5/48

[52] U.S. Cl. ..... 313/493; 313/318; 313/634

[58] Field of Search ..... 313/44, 318, 493, 634

[56] References Cited

U.S. PATENT DOCUMENTS 4,599,536 7/1986 Steeger et al. ..... 313/318

4,694,215 9/1987 Hofmann ..... 313/44

4,803,401 2/1989 Matsuno et al. ..... 313/493

FOREIGN PATENT DOCUMENTS 54-155675 12/1979 Japan .

*Primary Examiner*—Donald J. Yusko

*Assistant Examiner*—N. D. Patel

*Attorney, Agent, or Firm*—Cushman, Darby & Cushman

[57] ABSTRACT

Opposite ends of the bent arc bulb of a compact type fluorescent lamp having a relatively long crooked arc path are loosely supported by the base through holes, respectively. Each hole has an outer distance formed between the outer side surface of the end portion of the arc bulb and the edge of the hole greater than the inner distance defined between the inner side surface of the end portion of the arc bulb and the edge of the hole when the lamp is not operated. Each outer distance allows the outward movement of the corresponding end portions of the arc bulb over a variable moving distance under the influence of heat when the lamp is operated.

7 Claims, 7 Drawing Sheets

COMPACT TYPE FLUORESCENT LAMP DEVICE HAVING CROOKED ARC PATH

This is a continuation of Ser. No. 07/581,216, filed On Sep. 11, 1990, abandoned.

BACKGROUND OF THE INVENTION

1. Field of the Invention

The present invention relates, in general, to fluorescent lamp devices. In particular, the invention relates to a compact type fluorescent lamp device having a plurality of straight arc bulbs closely disposed in parallel to one another. One end of each arc bulb is connected to another are bulb to form a relatively long crooked arc path.

2. Description of the Related Art

In recent years, the external shape of the arc bulb of a fluorescent lamp device has been changed to reduce the size thereof without decreasing the entire arc path thereof. In such a compact type fluorescent lamp device, the arc bulb thereof is formed in a H shape, a U shape, or a W-shape. One of the conventional compact type fluorescent lamp device is shown in FIGS. 1, 2 and 3. A pair of straight-shaped bulbs 11*a* and 11*b* of the fluorescent lamp device is extended in parallel to one another from a base 15. The extended end of each arc bulb 11*a*, 11*b* is communicated through a connecting tube 17. Thus, a substantially U-shaped arc path is formed in the pair of straight-shaped bulbs 11*a* and 11*b* and connecting tube 17 extended between straight-shaped bulbs pair 11*a* and 11*b*, as shown in FIG. 2. A stem 19*a*, 19*b* is provided to the other end of each straight-shaped bulb 11*a*, 11*b*. A pair of electrodes 21*a* and 21*b* is respectively disposed in each bulb 11*a*, 11*b* and is supported by stem 19*a*, 19*b*. A fluorescent material 23 is coated on the inner surface of each bulb 11*a*, 11*b*. A prescribed amount of a fill including mercury and a starting rare gas is sealed in bulbs 11*a* and 11*b*.

Base 15 includes a connector portion 25 and a pedestal portion 27, which are formed with an insulating material, e.g., synthetic resin. A first pair of base pins 29*a* is extended outward from connector portion 25. Both terminals of electrode 21*a* and first base pins pair 29*a* are electrically connected through a lead wire 31*a*, respectively. A second pair of base pins 29*b* also is extended outward from connector portion 25 Both terminals of electrode 21*b* and second base pins pair 29*b* also are electrically connected through a lead wire 31*b*, respectively. As shown in FIG. 2, the other end of each bulb 11*a*, 11*b* at which the pair of electrodes 21*a* and 21*b* is disposed is respectively inserted into pedestal portion 27 through a pair of holes 33*a* and 33*b*. The inserted end portion of each bulb 11*a*, 11*b* is supported such that a space between the inner surface of pedestal portion 27 and the circumferential surface of tho inserted end portion of each bulb 11*a*, 11*b* is filled with an elastic bonding agent 35, e.g., silicone.

In the above-described conventional fluorescent lamp device, diameters of the holes pair 33*a* and 33*b* are slightly greater than the external diameters of the bulbs pair 11*a* and 11*b* to easily insert the other end of each bulb 11*a*, 11*b* into the corresponding holes 33*a* and 33*b*. According to a design practice, it is designed such that the axis of each bulb 11*a*, 11*b* is coincident with the center of the corresponding holes 33*a* and 33*b*. Thus, a constant gap is maintained between the circumferential surface of each bulb 11*a*, 11*b* and the corresponding holes 33*a* and 33*b* in a radial direction. In other words, as shown in FIG. 3, an inner distance (a) is formed between the edge of hole 33*a* and the inner side surface of bulb 11*a* adjacent to bulb 11*b*, and an outer distance (c) also is formed between the edge of hole 33*a* and the outer side surface opposite to the above-described inner side surface of bulb 11*a*. In the same manner, an inner distance (b) is defined between the edge of hole 33*b* and the inner side surface of bulb 11*b* adjacent to bulb 11*a*, and an outer distance (d) is formed between the edge of hole 33*a* and the outer side surface opposite to the inner side surface of bulb 11*b*. Thus, each distance (a), (b), (c), (d) has the same dimension as one another.

In the above-described conventional compact type fluorescent lamp device, the output power of the lamp device was at most 36 watt (W) because of its compact external size. However, in recent years, a high output power fluorescent lamp device of the type, e.g., 55 watt (W), 96 watt (W), etc., has been developed. In the above-described low output power fluorescent lamp device, an entire length h of the arc bulb thereof, shown in FIG. 2, is about 410 (mm). However, in the high output power fluorescent lamp device described above, a distance between a pair of electrodes (an arc path) is more than 1000 (mm), and an entire length h is more than 560 (mm).

In the above described high output power fluorescent lamp device, cracks were observed in connecting tube 17, shown in FIGS. 1 and 2, during the operation of the lamp device. The inventor discovered cause of the cracks occurring in connecting tube 17 of the lamp such as a H-shaped fluorescent lamp device. When the H-shaped fluorescent lamp device shown in FIG. 2 is operated, arc tube 13 is heating and the temperature of the inner side surface of each bulb 11*a*, 11*b* facing to one another becomes greater than that of the outer side surface of each bulb 11*a*, 11*b*. This is because heat from the outer side surface of each bulb 11*a*. 11*b* is smoothly radiated. However, the inner Side surface of each bulb 11*a*, 11*b* is subject to a heat radiation from the inner side surface of the other bulb. Furthermore, an air convection scarcely occurs in a space defined by bulbs 11*a* and 11*b* adjacent to one the other. Thus, the inner side surface of each bulb 11*a*, 11*b* is expanded toward its opposite ends and the end portion of each bulb 11*a*, 11*b* in which electrodes 21*a* and 21*b* are respectively disposed is warped outwardly so as to move apart from one another, as indicated by an imaginary line m in FIG. 2. In addition, the temperature of the inner side surface of connecting tube 17 exposed to the space between bulbs 11*a* and 11*b* is higher than that of other surfaces thereof in a circumferential direction. For instance, when the H-shaped fluorescent lamp device of a 55 watt (W) rating was operated in a horizontal state at a room temperature of 25 degree centigrade (°C.), the temperature of the inner side surface of bulb 11*b* at a point A shown in FIG. 2 was 90 degree centigrade (°C.) and the temperature of the outer surface of bulb 11*b* at a point B was 70 degree centigrade (°C.). Thus, it was observed that the distance between end portions of bulbs 11*a* and 11*b* was expanded to 3 to 5 (mm).

However, the mutual outward movement of the end portions of bulbs 11*a* and 11*b* is forcibly prevented by the corresponding edges of each hole 33*a*, 33*b* of base 15. Thus, connecting portion 17 receives a force caused by the expansion of the inner side surface of each bulb 11*a*, 11*b*. This results cracking of connecting portion 17.

SUMMARY OF THE INVENTION

Accordingly, it is an object of the present invention to avoid cracking of the connecting portion of a compact type fluorescent lamp device.

It is another object of the invention to absorb a force acting on the connecting portion of the arc tube which is caused by the Outward expansion of the opposite inner side surfaces of the arc tube under the influence of heat in a compact type fluorescent lamp device.

To accomplish the above-described objects, a compact type fluorescent lamp device includes a bent bulb for defining a crooked arc path therein, a pair of electrodes each disposed in the opposite sealed ends for producing an arc therebetween along the crooked arc path, a base for elastically supporting the opposite sealed ends of the bent bulb, and an allowing construction formed in the base for ensuring a variable moving distance of the opposite ends of the bent bulb caused by the outward expansion of the opposite inner side surfaces of the bent bulb. The allowing construction includes first and second holes formed in the base for respectively receiving the opposite ends of the bent bulb. The opposite ends each have an inner side surface facing each other and an outer side surface opposite to the inner side surface. The inner side surface of one of the opposite ends and the inner side edge of the first hole define a first inner distance A. The outer side surface of the one of the opposite ends and the outer side edge of the first hole define a first outer distance C greater than the first inner distance A. The inner side surface of the other end and the inner side edge of the second hole define a second inner distance B. The outer side surface of the other end and the outer side edge of the second hole define a second outer distance D which is greater than the second Inner distance B. The first and second inner distances A and B and the first and second outer distances C and D satisfying the following relationship:

$$A+B<C+D.$$

The base may include a bonding agent for elastically supporting the opposite ends of the bent bulb in the base.

BRIEF DESCRIPTION OF THE DRAWINGS

These and other objects and advantages of this invention will become apparent from the following detailed description of the presently preferred embodiment of the invention, taken in conjunction with the accompanying drawings, wherein like reference numerals throughout the various figures denote like structural elements and wherein.

DETAILED DESCRIPTIONS OF THE PREFERRED EMBODIMENTS

Figure 1:
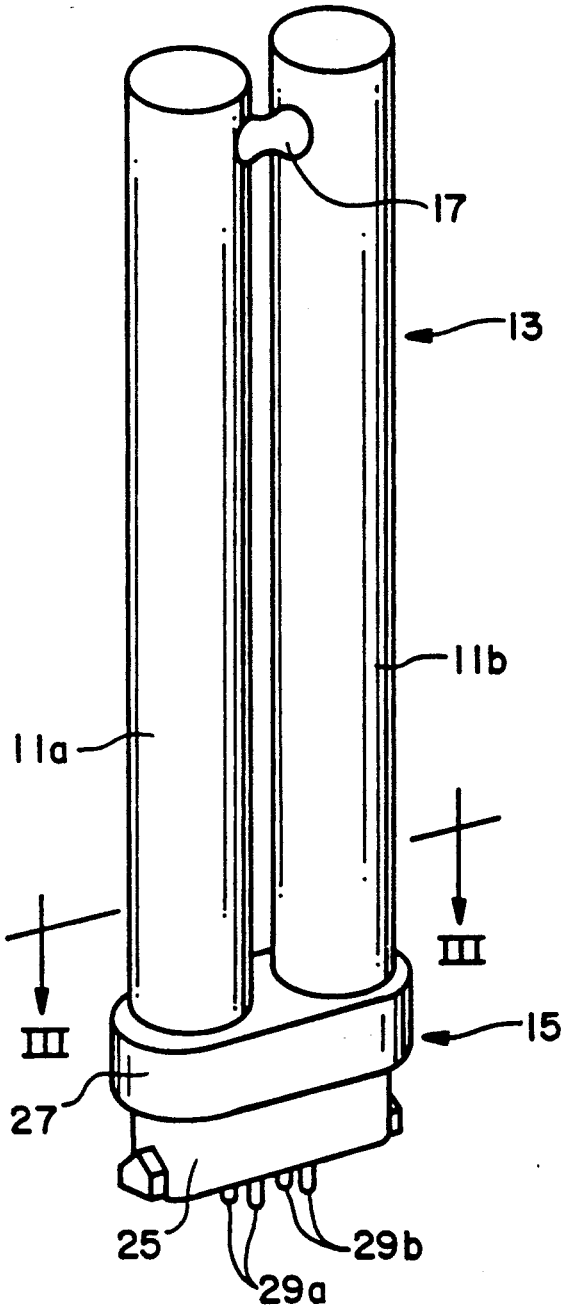
FIG. 1 (PRIOR ART)
FIG. 1 is a perspective view illustrating a conventional compact type fluorescent lamp device.
Figure 2:
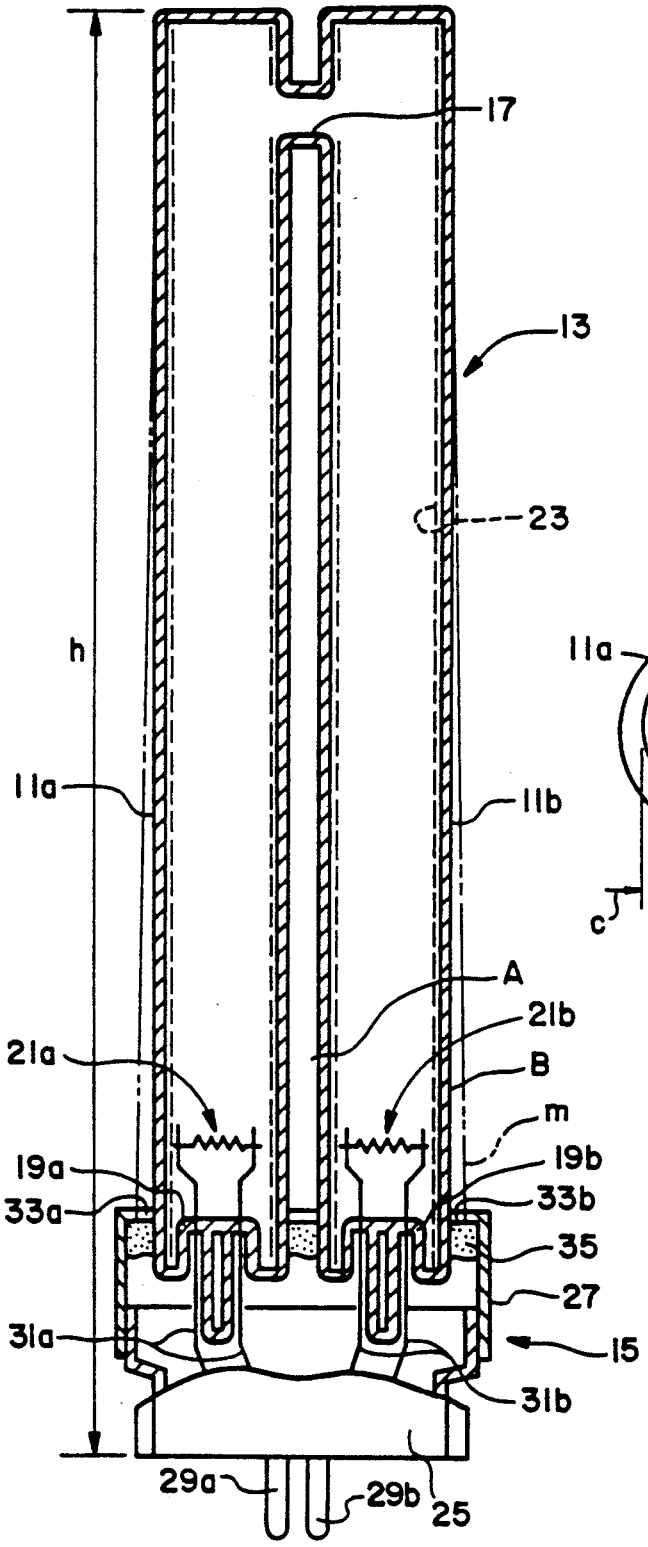
FIG. 2 (PRIOR ART)
FIG. 2 is a sectional view illustrating the compact type fluorescent lamp device shown in FIG. 1.
Figure 3:
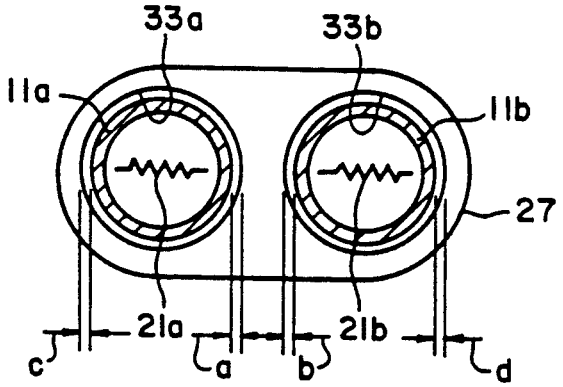
FIG. 3 (PRIOR ART)
FIG. 3 is a sectional view taken on line III—III of FIG. 1.
Figure 4:
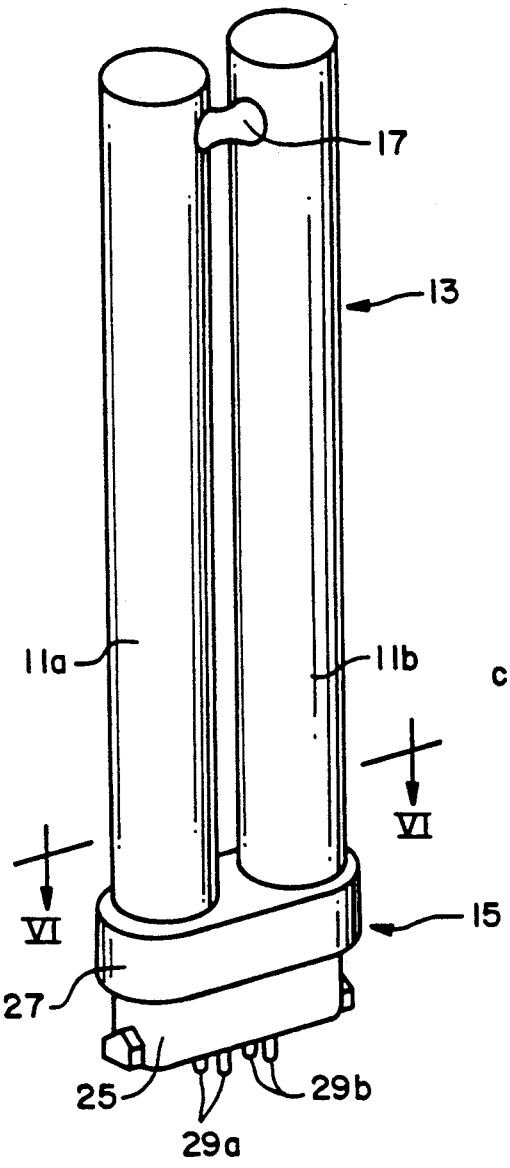
FIG. 4 is a perspective view illustrating a compact type fluorescent lamp device of one embodiment of the present invention.
Figure 6:
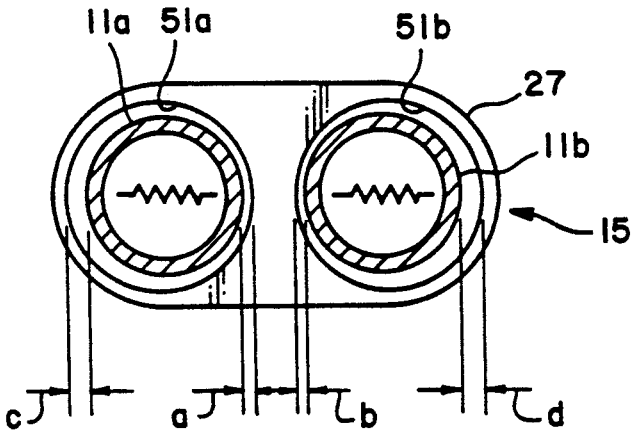
FIG. 6 is a sectional view taken on line VI—VI of FIG. 4.
Figure 5:
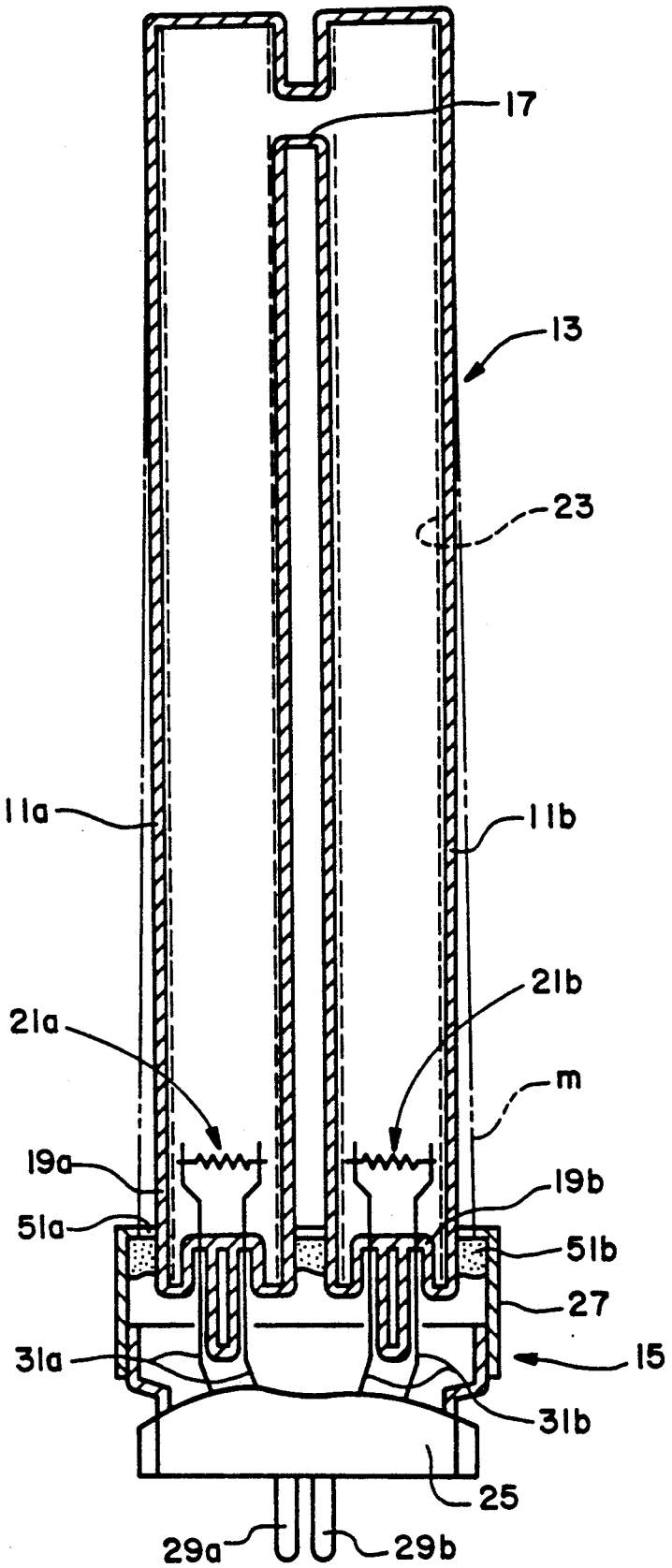
FIG. 5 is a cross sectional view illustrating the compact type fluorescent lamp device shown in FIG. 4.

Three preferred embodiments of the present invention will no be described in more detail with reference to the accompanying drawings. In FIGS. 4, 5 and 6, however, the same numerals are applied to the elements similar to those in FIGS. 1, 2 and 3, and therefore, the detailed descriptions thereof are not repeated.

A major difference between the compact type fluorescent lamp device of one embodiment and the conventional lamp device is the structure of a pair of holes **51*a* and 51*b* formed in pedestal portion 27 of base 15. In this embodiment, short inner distances (a) and (b) are defined between the inner side surface of each bulb 11*a*, 11*b* facing one another and the corresponding edge of each hole 51*a*, 51*b*, as shown in FIG. 6. Relatively long outer distances (c) and (d), compared with inner distances (a) and (b), are also defined between the outer side surface of each bulb 11*a*, 11*b* opposite to the inner side surface thereof and the corresponding edge of each hole 51*a*, 51*b*. In view of a design practice, the relationship between inner distances (a) and (b) and outer distances (c) and (d) is determined such that inner distance (a) is shorter than outer distance (c) in hole 51*a*, and inner distance (b) is shorter than outer distance (d) in hole 51*b* when the lamp device is not operated. Considering unavoidable errors in dimension when forming, processing or assembling arc bulbs 11*a* and 11*b* and the pair of holes 51*a* and 51*b***, it is preferable to determine the relationship between inner distances (a) and (b) and outer distances (c) and (d) as follows: $a+b<c$ and $a+b<d$. However, at least a following relationship should be satisfied: $a+b<c+d$.

With the above-described construction of one embodiment of the present invention, since outer distances (c) and (d) of holes **51*a* and 51*b* are relatively longer and bonding agent 35 has an elasticity, the distances (c) and (d) of holes 51*a* and 51*b* ensure the outward movement of the end portion of each bulb 11*a*, 11*b* over a variable moving distance of each end portion in base 15 when the inner side surface of each bulb 11*a*, 11*b*** is expanded under the influence of heat during operation of the lamp, as indicated by an imaginary line m in FIG. 5.

As described above, since the end portions of bulbs **11*a* and 11*b* at which the pair of electrodes 21*a* and 21*b* is disposed can be moved outwardly in the corresponding holes 51*a* and 51*b*, the force acting on connecting tube 17 is absorbed. Thus, cracking of connecting tube 17** is avoided.

In the above-described embodiment, the present invention is applied to the H-shaped arc bulb. However, the invention may by applied to a U-shaped arc bulb formed by bending a straight-shaped arc bulb. Similar effects can also be obtained in the U-shaped arc bulb.

Figure 7:
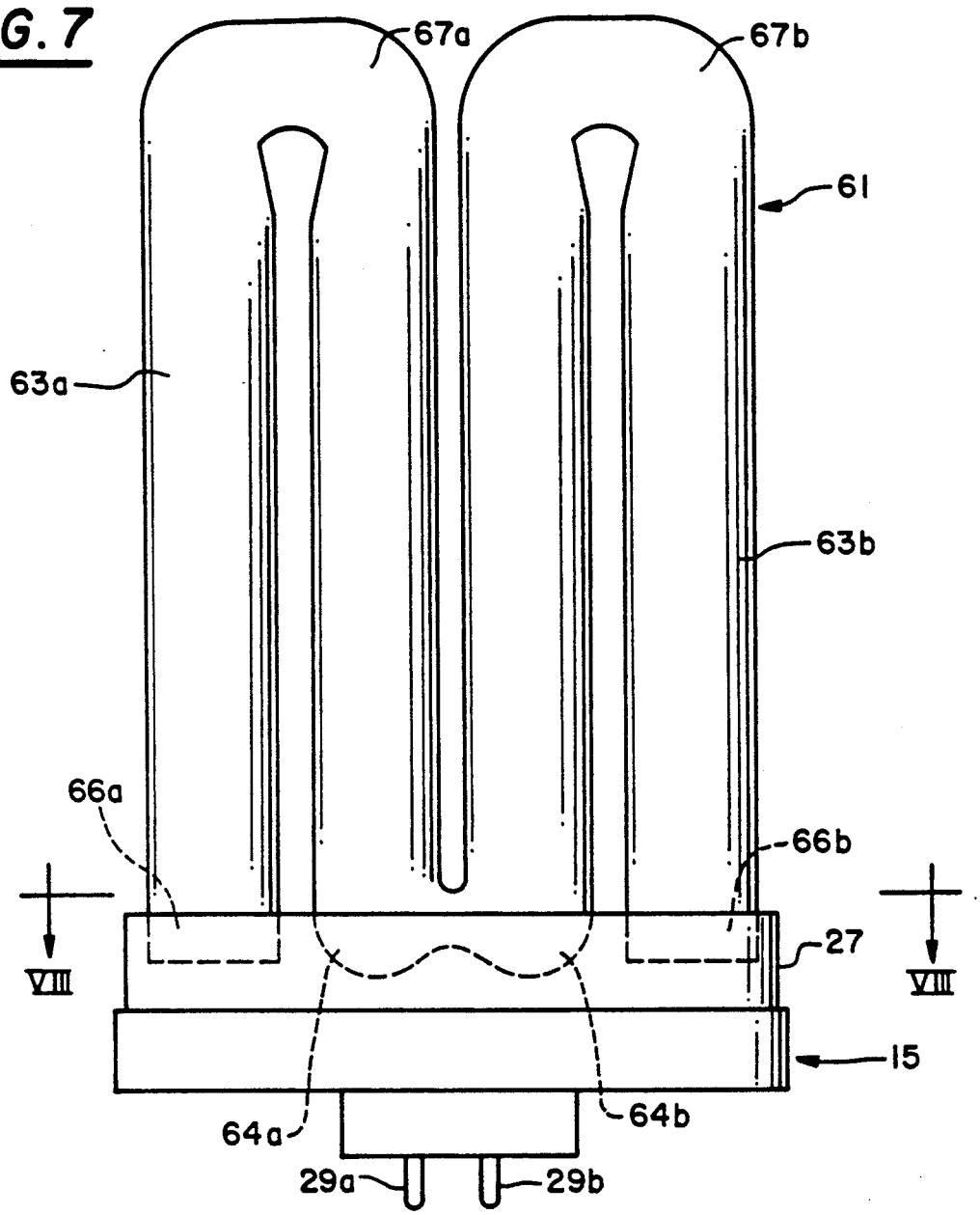
FIG. 7 is an elevational view illustrating a compact type fluorescent lamp of a second embodiment of the invention.
Figure 8:
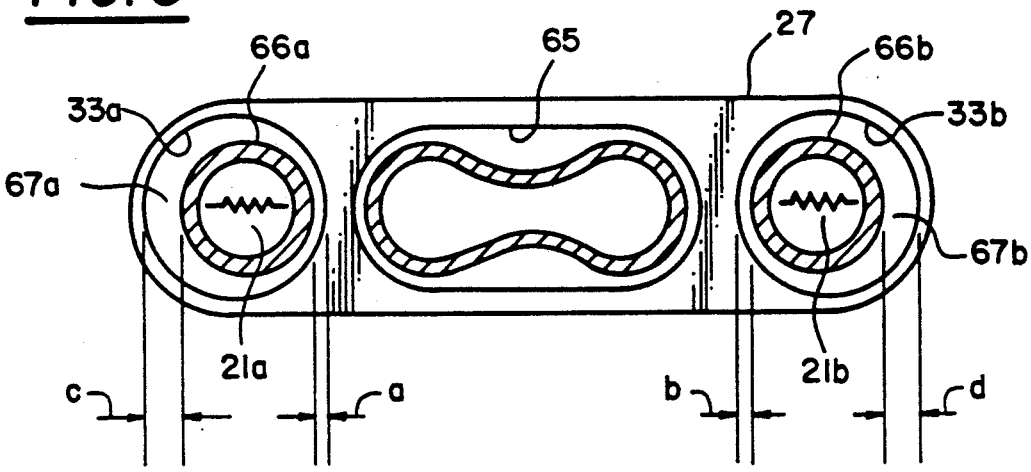
FIG. 8 is a sectional view taken on line VIII—VIII of FIG. 7.

A second embodiment of the present invention will be described with reference to FIGS. 7 and 8. In this embodiment, the present invention is applied to a reverse W-shaped arc bulb 61. As shown in FIG. 7, reverse W-shaped arc bulb 61 includes a first U-shaped bulb 63*a* and a second U-shaped bulb 63*b*. The outside surface of one of the ends 64*a* of first U-shaped bulb 63*a* is heated and the corresponding surface of one of the ends 64*b* of second U-shaped bulb 63*b* is also heated. Each heated portion of first and second U-shaped bulbs 63*a* and 63*b* is closely opposed and is connected to one another by the blow off process to fluidly communicate to one another. A first electrode 21*a*, shown in FIG. 8, is disposed in the other end 66*a* of first U-shaped bulb 63*a*, and a second electrode 21*b* also is arranged in the other end 66*b* of second U-shaped bulb 63*b*. Thus, a substantially W-shaped arc path is formed in the connected first and second U-shaped bulbs 63*a* and 63*b*. As shown in FIG. 8, a wide recess 65 is formed at the center of pedestal portion 27 of base 15 to house the connected portion of first and second U-shaped bulbs 63*a* and 63*b*. The pair of holes 33*a* and 33*b* is respectively formed at the opposite sides of wide recess 65 in pedestal portion 27. The other ends 66*a* and 66*b* of first and second U-shaped bulbs 63*a* and 63*b* at which the first and second electrodes 21*a* and 21*b* are disposed are respectively inserted into the corresponding holes 33*a* and 33*b*, and are supported with the elastic bonding agent (not shown) filled in pedestal portion 27.

In the above-described second embodiment, a circumferential gap 67*a* is formed between the other end 66*a* of first U-shaped bulb 63*a* and hole 33*a*. A first inner distance (a) between the inner side surface of the other end 66*a* of first U-shaped bulb 63*a* closely facing the one of the ends 64*a* of first U-shaped bulb 63*a* and the edge of hole 33*a* is smaller than a first outer distance (c) between the outer side surface of the other end 66*a* opposite to the inner side surface and the edge of hole 33*a* when the lamp device is not operated. In the same manner, a circumferential gap 67*b* is formed between the other end 66*b* of second U-shaped bulb 63*b* and hole 33*b*. A second inner distance (b) between the inner side surface of the other end 66*b* of second U-shaped bulb 63*b* closely facing the one of the ends 64*b* of second U-shaped bulb 63*b* and the edge of hole 33*b* is smaller than a second outer distance (d) between the outer side surface of the other end 66*b* opposite to the inner side surface and the edge of hole 33*b* when the lamp device is not operated. In the above-described inner and outer distances (a), (b), (c) and (d), at least a following relationship should be satisfied:

$$a+b<c+d.$$

In a conventional fluorescent lamp of the reverse W-shape type, it was observed that cracks occurred at each bent portion of U-shaped bulbs 63*a* and 63*b*. However, in this embodiment, the outward movement of each the other end 66*a*, 66*b* of first and second U-shaped bulbs 63*a* and 63*b* is allowed by first and second outer distances (c) and (d) of the corresponding holes 33*a* and 33*b* over a variable moving distance of each the other end 66*a*, 66*b*. Thus, occurrence of cracks in each bent portion 69*a*, 69*b* of reverse W-shaped arc bulb 61 can be avoided.

Figure 9:
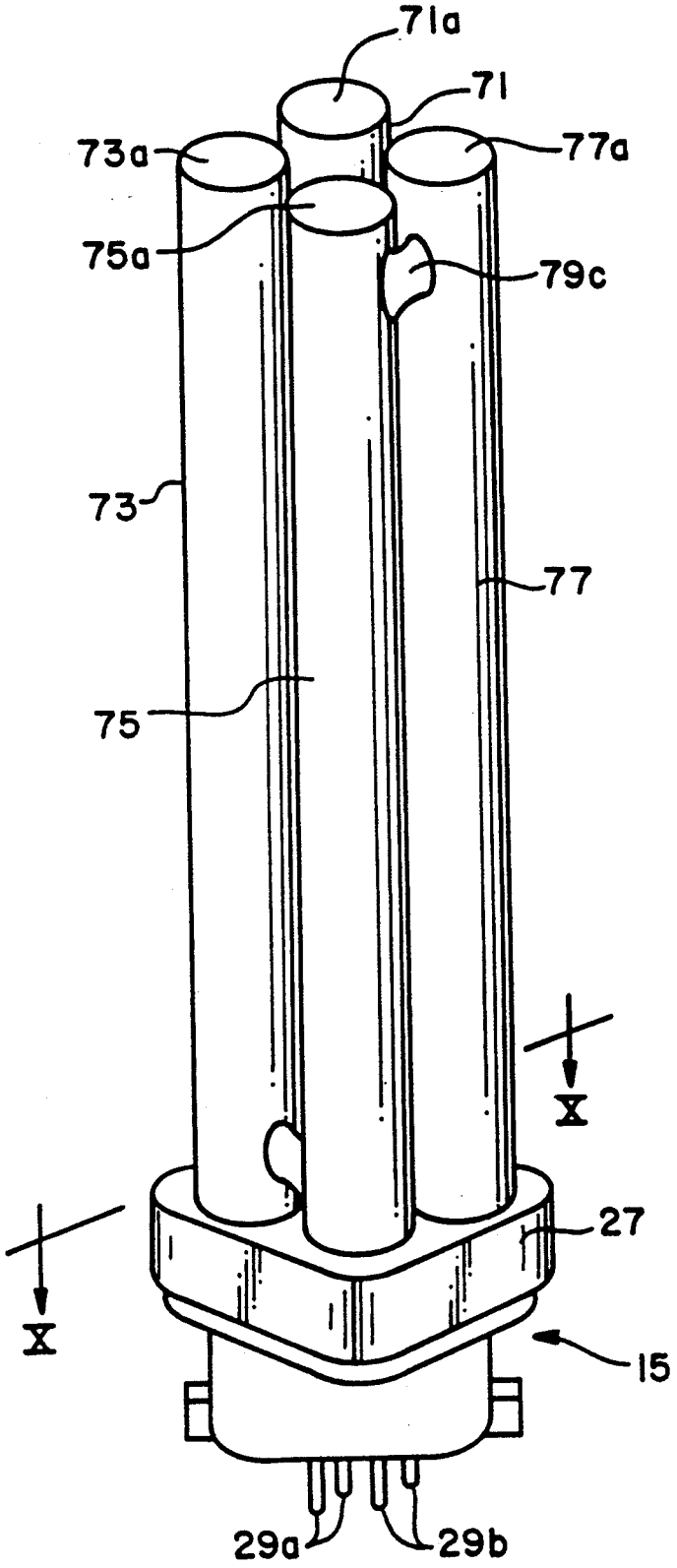
FIG. 9 is an elevational view illustrating a compact type fluorescent lamp of a third embodiment of the present invention.
Figure 10:
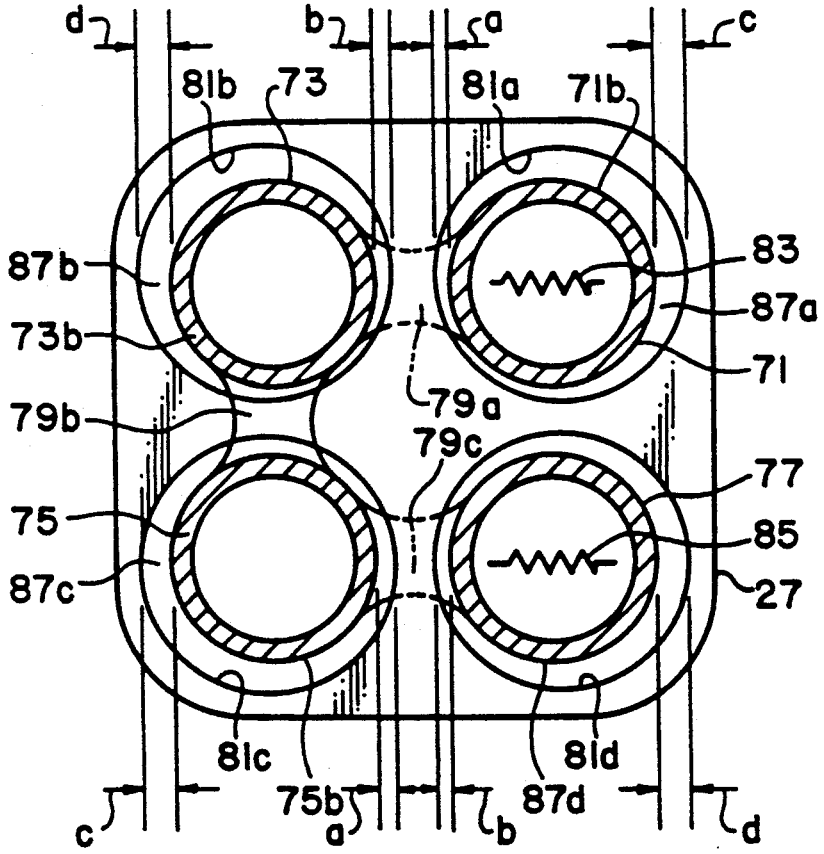
FIG. 10 is an enlarged sectional view taken on line IX—IX of FIG. 9.

A third embodiment of the present invention will now be described with reference to FIGS. 9 and 10. As shown in FIG. 9, first, second third and fourth straight bulbs 71, 73, 75 and 77 are rectangularly arranged on pedestal portion 27 of base 15, and perpendicularly extend from pedestal portion 27. 27 The extended end portion 71*a* of first bulb 71 is connected to the extended end portion 73*a* Of second bulb 73 by a first connecting tube 79*a* to fluidly communicate to one another. The base end portion 71*b* of first bulb 71 opposite to the extended end portion 71*a* is disposed in a first hole 81*a* formed in pedestal portion 27 of base 15. The base end portion 73*b* of second bulb 73 opposite to the extended end portion 73*a* is disposed in a second hole 81*b* formed in pedestal portion 27. The inner side surface of second bulb 73, facing third bulb 75, in the visinity of base end portion 73*b* is connected to the corresponding portion of third bulb 75 by a second connecting tube 79*b*, as shown in FIG. 9. Thus, second bulb 73 and third bulb 75 are fluidly communicated to one another. The extended end portion 75*a* of third bulb 75 is connected to the corresponding portion 77*a* of fourth bulb 77 by a third connecting tube 79*c* to fluidly communicate to one another. The base end portion 75*b* of third bulb 75 is disposed in a third hole 81*c* formed in pedestal portion 27, and the base end portion 77*b* of fourth bulb 77 is disposed in a fourth hole 81*d* in pedestal portion 27. Each base end portion 71*b*, 73*b*, 75*b*, 77*b* of first, second, third and fourth bulbs 71, 73, 75 and 77 is supported by an elastic bonding agent (not shown) filled in pedestal portion 27. A first electrode 83 is supported in the base end portion 71*b* of first bulb 71, and a second electrode 85 is supported in the base end portion 77*b* of fourth bulb 77. Thus, a relatively long arc path is formed through first bulb 71, first connecting tube 79*a*, second bulb 73, second connecting tube 79*b*, third bulb 75, third connecting tube 79*c* and fourth bulb 77.

In the above-described embodiment, a circumferential gap 87*a* is formed between the base end portion 71*b* of first bulb 71 and first hole 81*a*. A first inner distance (a) is defined by the inner side surface of the base end portion 71*b* closely facing the base end portion 73*b* of second bulb 73 and the edge of first hole 81*a*, as shown in FIG. 10. A first outer distance (c) is defined by the outer side surface of the base end portion 71*b* opposite to the inner side surface of the base end portion 71*b* and the edge of first hole 81*a*. First outer distance (c) is greater than first inner distance (a) when the lamp device is not operated. In second hole 81*b*, a circumferential gap 87*b* also is formed between the base end portion 73*b* of second bulb 73 and second hole 81*b*. A second inner distance (b) is defined by the inner side surface of the base end portion 73*b* closely facing the base end portion 71*b* of first bulb 71 and the edge of second hole 81*b*. A second outer distance (d) is defined by the outer side surface of the base end portion 73*b* of second bulb 73 opposite to the inner side surface of the base end portion 73*b* and the edge of second hole 81*b*. Second outer distance (d) is greater than second inner distance (c) when the lamp device is not operated. Thus, a value obtained by adding first outer distance (c) to second outer distance (d) is usually greater than a value obtained by adding first inner distance (a) to second inner distance (b) when the lamp device is not operated even if an error in measurement in assembling is taken into consideration. In the same manner, a circumferential gap 87*c* is formed between tho base end portion 75*b* of third bulb 75 and third hole 81*c*. A third inner distance (a) is defined by the inner side surface of the base end portion 75*b* and the edge of third hole 81*c*. A third outer distance (c) is also defined by the outer side surface of the base end portion 75*b* of third bulb 75 opposite to the inner side surface of the base end portion 75*b* and the edge of third hole 81*c*. Third outer distance (c) is greater than third inner distance (a) when the lamp device is not operated. In fourth hole 81*d*, a circumferential gap 87*d* is formed between the base end portion 77*b* of fourth bulb 77 and fourth hole 81*d*. A fourth inner distance (b) is defined by the inner side surface of the base end portion 77*b* closely facing the base end portion 75*b* of third bulb 75 and the edge of fourth hole 81*d*. A fourth outer distance (d) is defined between the outer side surface of the base end portion 77*b* opposite to the inner side surface of the base end portion 77*b* and the edge of fourth hole 81*d*. Fourth outer distance (d) is greater than fourth inner distance (b) when the lamp device is not operated. In this case also, a value obtained by adding third outer distance (c) to fourth outer distance (d) is usually greater than a value obtained by adding third inner distance (a) to fourth inner distance (b) when the lamp device is not operated. Second hole 81*b* and third hole 81*c* may be communicated to one another, as a substantially common hole. However, the above-described relationship between second inner and outer distances (c) and (d) should be maintained. The relationship between third inner and outer distances (a) and (b) should also be maintained, as described above.

In the above-described embodiment, the outward movement of each first and second bulbs 71 and 73 occurs between first and second bulbs 71 and 73 whose extended end portions 71*a* and 73*a* are connected by first connecting tube 79*a* during the operation of the lamp device. However, since relatively long first and second outer distances (c) and (d) are formed between the first outer surface of the base end portion 71*b* and the edge of first hole 81*a* and the second outer surface of the base end portion 73*b* and the edge of second hole 81*b*, the base end portion 71*b* of first bulb 71 and the base end portion 73*b* of second bulb 73 move outward in the corresponding distances (o) and (d) to absorb a force acting on first connecting tube 79*a*. Thus, cracking of first connecting tube 79*a* can be avoided. In the same manner as described above, when the outward movement of each third and fourth bulb 75 and 77 occurs, the base end portion 75*b* of third bulb 75 and the base end portion 77*b* of fourth bulb 77 move outward in the corresponding distances (c) and (d) to absorb a force acting on third connecting tube 79*c*. Thus, cracking of third connecting tube 79*c* can also be prevented.

The present invention has been described with respect to specific embodiments. However, other embodiments based on the principles of the present invention should be obvious to those of ordinary skill in the art. Such embodiments are intended to be covered by the claims.

What is claimed is:

1. A compact type fluorescent lamp device comprising:

a bulb defining a crooked arc path therein, the bulb having first and second sealed ends which move outward so as to separate from each other at a variable moving distance during operation of the lamp;

a pair of electrode means, including a first electrode means disposed in the first sealed end, and a second electrode means disposed in the second sealed end, said electrode means for producing an arc between said first and second electrode means along the crooked arc path; and base means for supporting the first and second sealed ends of the bulb, the base means having first and second surface defining first and second holes for respectively receiving the first and second ends of the bulb, the first and second ends of the bulb each having inner side surfaces respectively facing each other, and outer side surfaces opposite to the inner side surfaces, said first surface having a first part which faces and is adjacent to said inner side surface of the bulb and a second part which faces and is adjacent to said outer side surface of the bulb, and said second surface also having a first part which faces and is adjacent to said inner side surface of the bulb, and a second part which faces and is adjacent to said outer side surface, said first parts being portions of said surfaces which are closest to said inner side surfaces and said second parts being portion of said surfaces which are closest to said outer side surfaces, the inner side surface of the first end of the bulb separated from said first part of said first surface by a first inner distance A, the outer side surface of the first end of the bulb separated from said second part of said first surface by a first outer distance C, the inner side surface of the second end of the bulb separated from said first part of said second surface by a second inner distance B, the outer side surface of the second end separated from said second part of said second surface by a second outer distance D, the first and second inner distances A and B and the first and second outer distances C and D satisfying the following relationship:

$$A+B<C+D.$$

2. A device according to claim 1, wherein the bulb has an inner surface, and includes a fluorescent material on the inner surface thereof.

3. A device according to claim 2, wherein the bent bulb means includes an amount of mercury and an amount of rare gas.

4. A device according to claim 1, wherein the bulb is substantially W-shaped and a wide recess in the base means receives a center portion of the bulb.

5. A compact type fluorescent lamp device comprising:

a first bulb, having a base end, an extended end and a defined length, for defining arc path;

a second bulb arranged in parallel to the first bulb for defining a second arc path, the second bulb having a base end, an extended end and a defined length;

connecting tube means for connecting the first arc path to the second arc path for forming a serial arc path between the extended end of the first bulb and the extended end of the second bulb;

a first electrode disposed in the base end of the first bulb;

a second electrode, associated with the first electrode, disposed in the base end of the second bulb for generating an arc along the serial arc path; and base means for supporting the base end of the first and second bulbs, wherein the base means has a first surface defining a first hole therein for loosely receiving the base end of the first bulb, the base end of the first bulb having an inner side surface facing the base end of the second bulb and an outer side surface opposite to the inner side surface, said first surface having a first part closest to said inner side surface and a second part closest to said outer side surface, the inner side surface of the base end of the first bulb separated from said first part of said first surface by a first inner distance A, the outer side surface of the base end of the first bulb separated from said second part of said first surface by a first outer distance C, and wherein the base means further has a second surface defining a second hole therein for loosely receiving the base end of the second bulb, the base end of the second bulb having an inner side surface facing the inner side surface of the base end of the first bulb and an outer side surface opposite to the inner side surface, and said second surface also having a first part closest to said inner side surface and a second part closest to said outer side surface, the inner side surface of the base end of the second bulb separated from said first part of said second surface by a second inner distance B, the outer side surface of the base end of the second bulb separated from said second part of said second surface by a second outer distance D greater than the second inner distance B, such that the first and second inner distances A and B and the first and second outer distances C and D satisfy the following relationship:

$$A+B<C+D.$$

6. A device according to claim 5, wherein the base means includes bonding agent means for elastically supporting portion of each of first and second bulb which are closest to one another.

7. A compact type fluorescent type device comprising:

at least one pair of bulbs including first and second bulbs arranged in parallel, each having a base end, an extended end and a defined length for defining arc paths, said at least one pair having inside surfaces facing each other, and outside surfaces facing in opposite directions from each other;

at least one connecting tube means, each for connecting two arc paths to form a serial arc path between two bulbs;

a first electrode disposed in the base end of the said first bulb;

a second electrode disposed in the base end of said second bulb; and base means for supporting ends of each pair of bulbs which are nearest one another, wherein said base means has first and second holes therein positioned for loosely receiving the base ends of the bulbs, said first hole having a first part closest to said inside surface and a second part closest to said outside surface and said second hole also having a first part closest to said inside surface and a second part closest to said outside surface, the base end of said first bulb of each pair being displaced towards said second bulb of the same pair in its respective hole, the inside surface of the base end of the first bulb of each pair separated from said first part of its respective hole by a first inner distance A, an outer side surface of the base end of the first bulb of each pair separated from said second part of its respective hole by a first outer distance C, and wherein the base end of the second bulb of each pair being displaced towards the first bulb of the same pair in its respective hole, the inside surface of the base end of the second bulb of each pair being separated from said first part of its respective hole by a second inner distance B, the outside surface of the base end of the second bulb of each pair being separated from said second part of its respective hole by a second outer distance D, such that the first and second inner distances A and B and the first and second outer distances C and D satisfy the following relationship:

$$A+B<C+D.$$

* * * * *